US006571673B2

(12) United States Patent
Piazza

(10) Patent No.: US 6,571,673 B2
(45) Date of Patent: Jun. 3, 2003

(54) METHOD AND APPARATUS FOR ADJUSTING THE INCLINATION OF THE LABEL IN A LABELING MACHINE FOR CONICAL OR NON-CYLINDRICAL CONTAINERS

(75) Inventor: Gastone Piazza, Marmirolo (IT)

(73) Assignee: Sig Alfa S.p.A, Mantova (IT)

( * ) Notice: Subject to any disclaimer, the term of this patent is extended or adjusted under 35 U.S.C. 154(b) by 0 days.

(21) Appl. No.: 09/893,169

(22) Filed: Jun. 27, 2001

(65) Prior Publication Data

US 2002/0040630 A1 Apr. 11, 2002

(30) Foreign Application Priority Data

Oct. 8, 2000 (IT) ..... PR00A0047

(51) Int. Cl.[7] ..... B26D 7/06

(52) U.S. Cl. ..... 83/418; 156/DIG. 33; 156/DIG. 37

(58) Field of Search ..... 83/236, 418; 156/252, 156/256, 270, DIG. 33, DIG. 28, DIG. 37, DIG. 5, DIG. 8, DIG. 9–14; 226/180, 21; 242/615.21; 53/410; 493/375, 376

(56) References Cited

U.S. PATENT DOCUMENTS 3,139,368 A 6/1964 Flood ..... 156/475
4,343,422 A * 8/1982 Dabringhaus et al. ..... 226/197
4,624,734 A * 11/1986 Voltmer et al. ..... 156/541
4,863,087 A 9/1989 Kohler ..... 226/197
5,016,801 A * 5/1991 Gilat et al. ..... 226/197
5,022,950 A * 6/1991 Ingalls et al. ..... 156/361
5,065,896 A * 11/1991 Jurgich ..... 221/73
5,277,571 A * 1/1994 Brining ..... 425/289
5,316,199 A * 5/1994 Hansen et al. ..... 226/197
5,374,042 A * 12/1994 Ring ..... 270/52
5,922,169 A * 7/1999 Chodacki et al. ..... 156/521

FOREIGN PATENT DOCUMENTS

EP 0501105 9/1992 ..... B65C/9/18

* cited by examiner

*Primary Examiner*—Jacob K. Ackun
*Assistant Examiner*—Jamila Williams
(74) *Attorney, Agent, or Firm*—Darby & Darby

(57) ABSTRACT

In a labeling machine for conical or non-cylindrical containers, comprising a cutting station for cutting a film of labels into segments constituting the individual labels to be affixed to the containers, an apparatus for adjusting the inclination of the label comprising an element anchored to an end of the rotating shaft of a roller for feeding the film of labels to the cutting station, and in said element is screwed a screw actuated from a knob in such a way as to cause the translation of the element and hence the movement of the rotating shaft of said roller for feeding the film to the cutting station.

The method provides, upstream of the cutting station, for the inclination of the direction of feeding of the film.

5 Claims, 4 Drawing Sheets

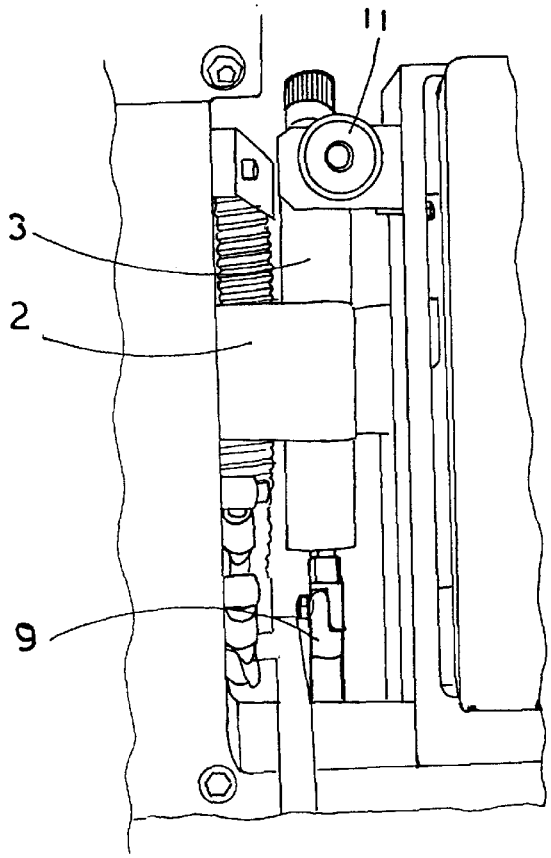
FIG. 3
FIG. 2
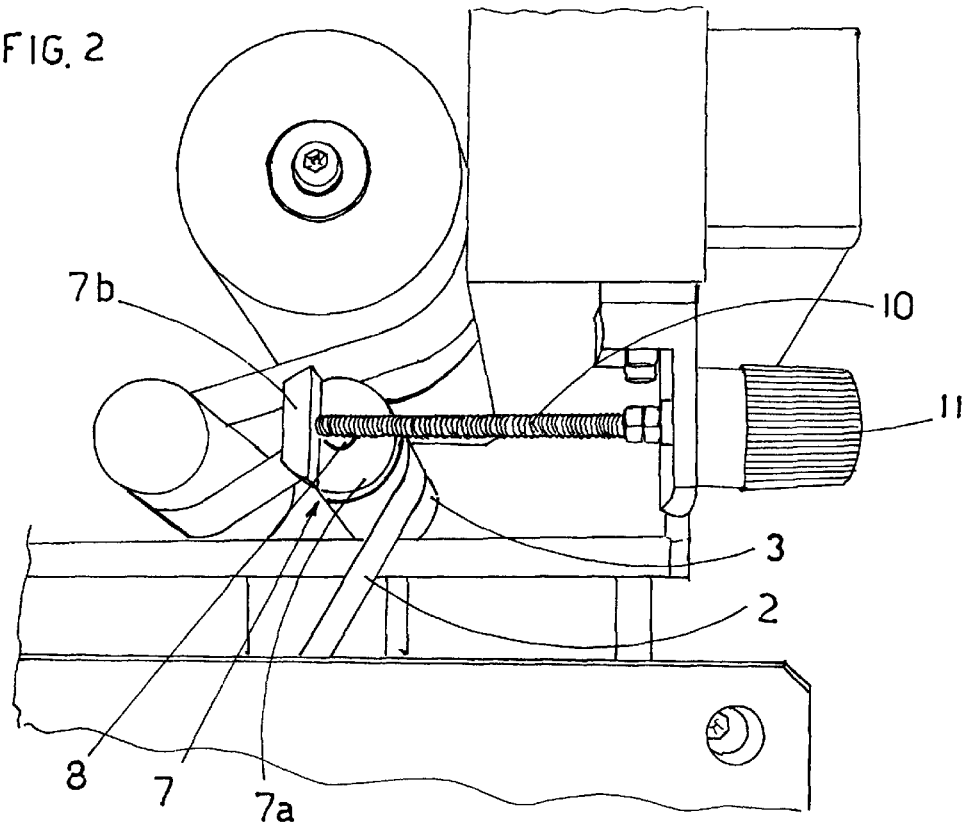

METHOD AND APPARATUS FOR ADJUSTING THE INCLINATION OF THE LABEL IN A LABELING MACHINE FOR CONICAL OR NON-CYLINDRICAL CONTAINERS

BACKGROUND OF THE INVENTION

The present invention relates to a method and an apparatus for adjusting the inclination of the label, in a labeling machine for conical or non-cylindrical containers.

Labeling machines are known in which a film constituting the labels, generally made of plastic material such as polypropylene or polyethylene, is wound on a reel from which it unwinds to reach a cutting station where the film is cut into segments, each of which substantially corresponds to a label, which segments are then taken up by an aspirating holed roller which feeds a gluing roller before the final application of the label onto the container.

In the case of containers in which the area of application of the label is not perfectly cylindrical but is, for instance, conical or deformed, the label tends to adhere to the container in such a way that the opposite short sides of the label are not perfectly superposed but give rise to a slight offset in height.

SUMMARY OF THE INVENTION

The aim of the present invention is to eliminate the aforesaid drawbacks, making available a method and an apparatus that allow to apply film labels also on non-cylindrical, and in particular conical, areas of containers.

A further aim is to obtain this in a particularly simple and economical manner and to allow to adjust the positioning of the labels even when the machine is in motion.

Said aims are fully achieved by the method and by the apparatus of the present invention, which are characterized by the content of the claims set out below.

In particular the method provides, upstream of the cutting station, for having the inclination of the direction of feeding of the film, relative to the substantially horizontal normal direction of feeding.

The apparatus comprises means shaped in such a way as to provide for an inclination of the direction of feeding of the label film to the cutting station.

Said means preferably comprise an element anchored to an end of the rotating shaft of a roller for feeding the label film to the cutting station. On said element is screwed a screw operated through a knob, and the rotation of the screw causes the translation of said element and hence the displacement of the rotating shaft of the roller that feeds the film to the cutting station.

The other end of the shaft of the roller that feeds the film to the cutting station is preferably anchored to a universal joint or to an articulated joint.

BRIEF DESCRIPTION OF THE DRAWINGS

This and other characteristics shall become more readily apparent from the following description of a preferred embodiment illustrated, purely by way of non limiting example, in the accompanying drawing tables, in which:

FIG. 2 shows a perspective top view of the apparatus;

FIG. 3 shows a front view of the apparatus.

DESCRIPTION OF THE PREFERRED EMBODIMENT

Figure 1:
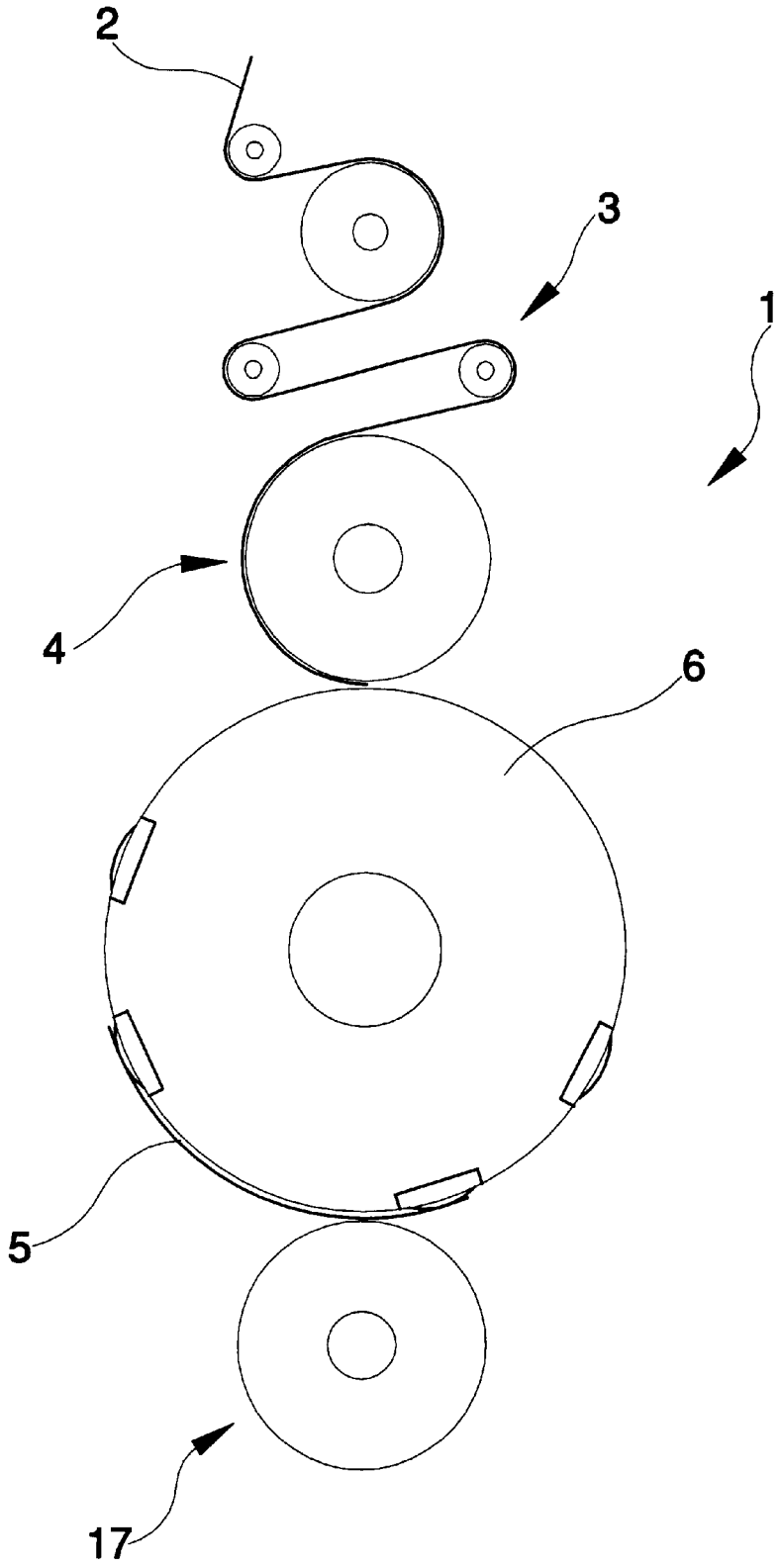
FIG. 1 schematically shows a plan view of the labeling machine.

With reference to the figures, the number 1 globally indicates a labeling machine for applying to containers labels obtained from a continuous film 2 that progressively unwinds from a reel that is not shown herein.

The film is normally, though not necessarily, a film made of plastic material such as polypropylene or polyethylene, which reaches a roller 3 feeding it to a cutting station 4 where the film is cut into segments or labels 5 by a blade and counter blade.

The film segments 5 are in fact the labels to be applied onto the containers.

The labels 5 then reach an aspirating holed transferring roller 6, whereto they adhere until their passage to a spreader roller 17 which deposits a linear layer of glue or adhesive substance in correspondence of the two short sides of the label (the label being rectangular).

The label is then transferred onto the container in a known manner.

The original feature of the present invention resides in the fact that the roller 3 feeding the film to the cutting station is not fixed in the vertical position, but can be inclined in an adjustable manner, even when the labeling machine is in motion.

This allows the label to arrive at the cutting station inclined, so as to be cut not in exactly rectangular shape, but to become a parallelogram with the sides that form angles deviating from perpendicularity by a few degrees, for instance 1–3° (for containers with slight conicity).

This is sufficient to compensate for the conicity of the container (and for the fact that the label tends to rise inclined thereon) and to cause the two short sides of the label to match perfectly during the superposition that takes place when the label is applied to the container.

Obviously, the roller 3 shall be inclined in the opposite direction to the direction towards which the label tends to incline during its application onto the container.

The roller 3 originally comprises adjusting means constituted by an element 7 formed by a plate 7*a* and by a block 7*b*, mutually integral (and preferably welded to each other). The plate 7*a* is holed to receive a first end of the shaft 8 of the roller 3, whilst the second end of the shaft 8 is anchored to an articulated joint 9, preferably a universal joint.

The block 7*b* has a hole with threaded horizontal axis into which is inserted a screw 10, manually actuated from a knob 11.

According to the method of the present invention, through the knob 11 it is possible, even with the machine in motion, to rotate the screw 10 and hence to translate the upper end of the roller 3 in such a way as to move the axis of the roller relative to its normal vertical lay.

Normally, for containers of slight conicity, an offset of about 1–3° is sufficient.

In this way the film enters the cutting station inclined (relative to the usual horizontal direction of feeding) and the label is cut in the shape of a parallelogram, instead of a perfect rectangle.

The inclination relative to the vertical may be adjusted in both directions depending on whether the label on the bottle is offset in height above or below a horizontal reference line.

Obviously, the apparatus may be employed also for cylindrical or otherwise shaped containers and the offset may be applied to any of the film transferring rollers located before the cutting station 4.

Figure 4A:
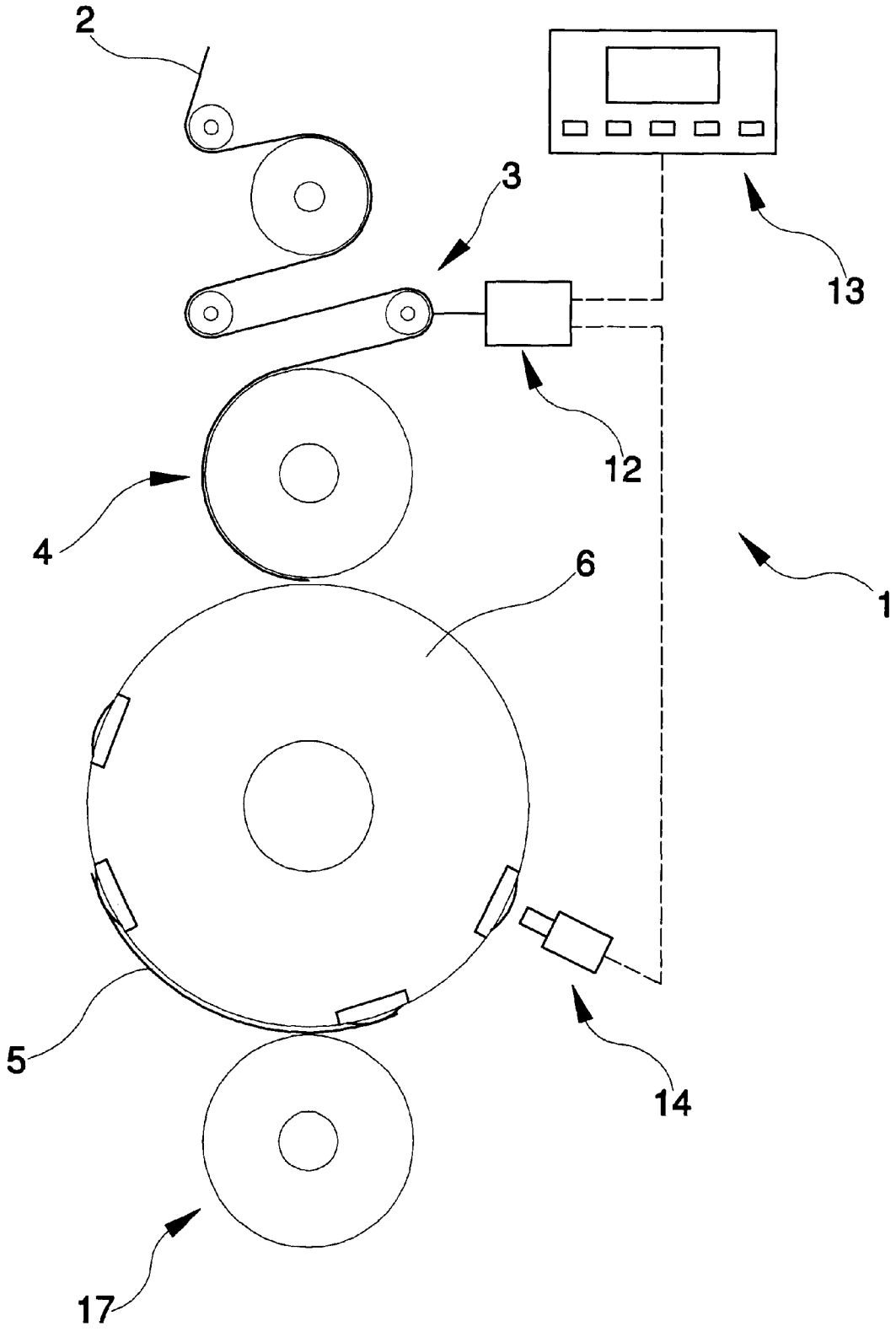
FIGS. 4A and 4B are views of another embodiment.
Figure 4B:
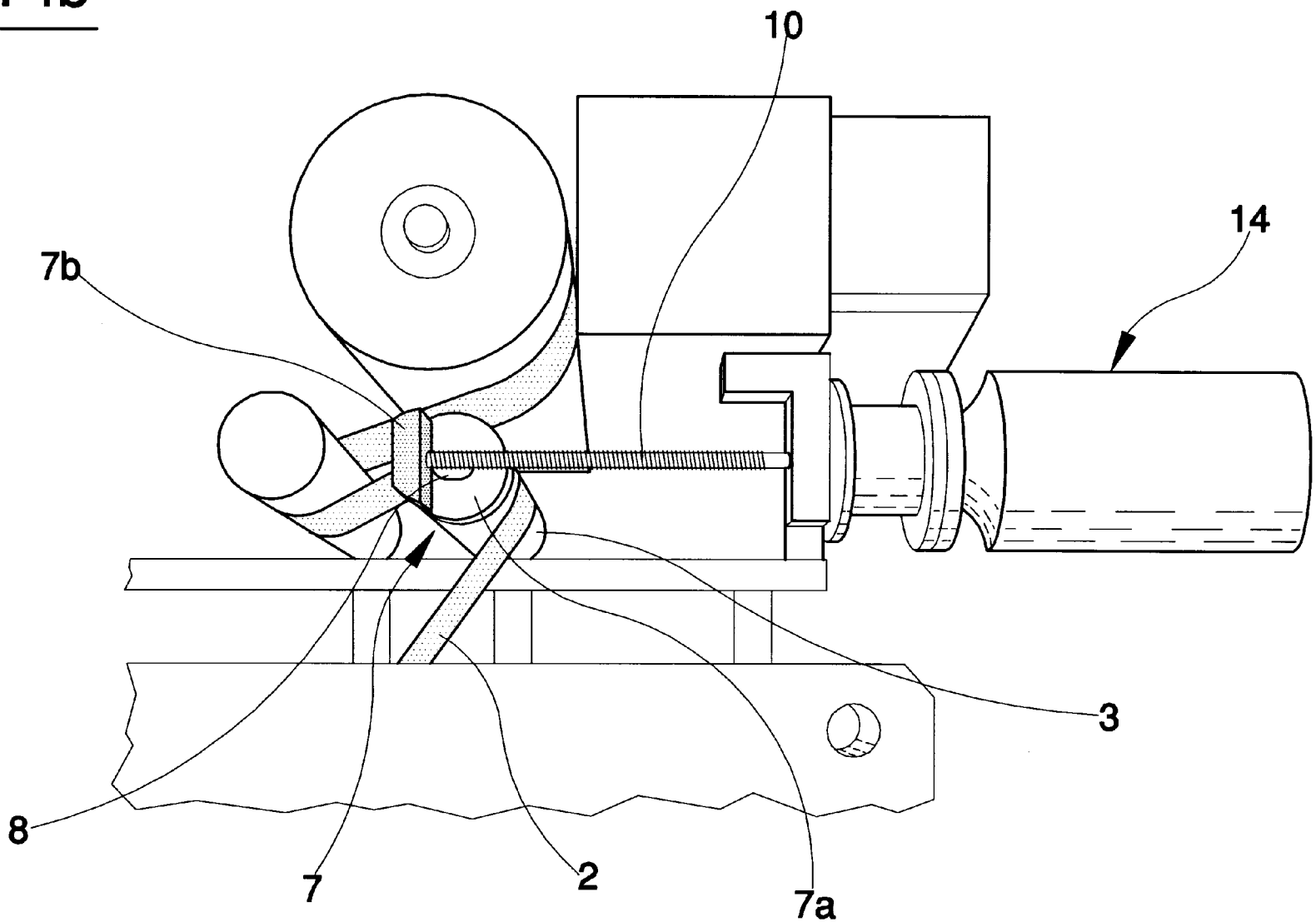

According to a possible variation as shown in FIGS. 4A and 4B, instead of the knob 11, an electric motor 12 is provided, for instance of the stepped kind, able to be supplied power through a pushbutton panel 13 controlled by an operator, or automatically by means of a device 14 able to measure the height offset of the label placed on the container.

The reader device 14 will send the signal to a processor which compares the signal with a sample signal and in case of deviation will cause the motor to rotate in one direction or the other depending on whether the height offset is greater or smaller.

What is claimed:

1. A labeling machine for applying labels to cylindrical, conical or otherwise shaped containers, comprising:

a cutting station for cutting a film of labels into segments constituting the individual labels to be affixed to the containers; and means to controllably adjust the inclination of the direction of feeding of the label film to the cutting station.

2. A machine as claimed in claim 1, wherein said means to controllably adjust the inclination comprises:

an element anchored to an end of a rotating shaft of a roller feeding the film of labels to the cutting station;

a screw actuated from a knob rotatable to produce translation of said element and the inclination of said rotating shaft of said roller feeding the film to said cutting station.

3. A machine as claimed in claim 2, wherein the other end of said shaft of said roller feeding the film to the cutting station is anchored to one of a universal joint and an articulated joint.

4. A machine as claimed in claim 2, further comprising an electric motor for rotating said screw; and means for supplying power to said motor by at least one of an operator through a pushbutton panel or automatically by a means for measuring the height offset of the label.

5. A method for adjusting the inclination of the label in a labeling machine for conical or non-cylindrical containers, comprising the steps of:

supplying a film of labels to a cutting station;

cutting said label film into segments constituting the individual labels to be affixed to the containers; and upstream of the cutting station adjusting the inclination of the direction of feeding of the film, relative to the substantially horizontal normal direction of feeding.

* * * * *